US009809947B2

(12) United States Patent
Gross et al.

(10) Patent No.: US 9,809,947 B2
(45) Date of Patent: Nov. 7, 2017

(54) DIPPER FOR A MINING SHOVEL

(71) Applicant: Harnischfeger Technologies, Inc., Wilmington, DE (US)

(72) Inventors: Matthew L. Gross, West Allis, WI (US); Nicholas Voelz, West Allis, WI (US); Richard Nicoson, Hartford, WI (US); Joseph J. Colwell, Hubertus, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 160 days.

(21) Appl. No.: 14/726,995

(22) Filed: Jun. 1, 2015

(65) Prior Publication Data

US 2015/0345105 A1 Dec. 3, 2015

Related U.S. Application Data

(60) Provisional application No. 62/006,451, filed on Jun. 2, 2014.

(51) Int. Cl.
*E02F 3/40* (2006.01)
*E02F 3/407* (2006.01)
*E02F 3/60* (2006.01)

(52) U.S. Cl.
CPC ..... *E02F 3/4075* (2013.01); *E02F 3/60* (2013.01)

(58) Field of Classification Search
CPC ... E02F 3/4075; E02F 3/46; E02F 3/40; E02F 3/407; E02F 3/60
USPC ..... 37/444–446; 192/35, 48.8; 414/597, 726
See application file for complete search history.

(56) References Cited

U.S. PATENT DOCUMENTS

| | | | | | |
|---|---|---|---|---|---|
| 665,682 | A * | 1/1901 | Hetlesaeter | E02F 3/4075 | 414/726 |
| 1,402,491 | A * | 1/1922 | Gow | E02F 3/40 | 37/444 |
| 1,725,858 | A * | 8/1929 | Esters | E02F 3/4075 | 292/123 |
| 1,803,654 | A * | 5/1931 | Ronk | E02F 3/60 | 37/444 |
| 1,807,028 | A * | 5/1931 | Culver | E02F 3/4075 | 192/35 |
| 1,821,499 | A * | 9/1931 | Culver | E02F 3/4075 | 192/35 |
| 2,003,067 | A * | 5/1935 | Brune | E02F 3/40 | 37/444 |
| 3,059,793 | A * | 10/1962 | Atkinson | E02F 3/4075 | 414/726 |
| 2013/0192101 | A1* | 8/2013 | Gilmore | E02F 9/006 | 37/445 |

* cited by examiner

*Primary Examiner* — Robert Pezzuto
(74) *Attorney, Agent, or Firm* — Michael Best & Friedrich LLP

(57) ABSTRACT

A dipper for a mining shovel includes a back wall, a first side wall extending from the back wall, a second side wall extending from the back wall, a front wall disposed opposite the back wall and extending between the first and second side walls, and a dipper door pivotally coupled to a bottom end of the dipper. The dipper door is movable between a latched and an unlatched position relative to the dipper. The dipper door is angled relative to the front wall at an acute angle when the dipper door is in the latched position.

24 Claims, 6 Drawing Sheets

DIPPER FOR A MINING SHOVEL

CROSS-REFERENCE TO RELATED APPLICATIONS

This application claims priority to U.S. Provisional Application No. 62/006,451, filed Jun. 2, 2014, the entire contents of which is incorporated herein by reference.

FIELD OF THE INVENTION

The present invention relates to the field of earthmoving machines. Specifically, the present invention relates to a dipper for a mining shovel.

A conventional rope mining shovel includes a boom, a handle moveably coupled to the boom, a dipper that is coupled to the handle, a bail that is coupled to the dipper, an equalizer that is coupled to the bail, and a hoist rope that is coupled to the equalizer. The hoist rope passes over a boom sheave coupled to an end of the boom, and is reeled in and paid out by a hoist drum.

During a hoist phase, the rope is reeled in by the hoist drum, lifting the dipper upward through a bank of material and liberating the material to be dug. To release the material disposed within the dipper, a dipper door is pivotally coupled to the dipper. When not latched to the dipper, the dipper door pivots away from a bottom of the dipper, thereby freeing the material out through a bottom of the dipper.

SUMMARY

In accordance with one construction, a dipper for a mining shovel includes a back wall, a first side wall extending from the back wall, a second side wall extending from the back wall, a front wall disposed opposite the back wall and extending between the first and second side walls, and a dipper door pivotally coupled to a bottom end of the dipper. The dipper door is movable between a latched and an unlatched position relative to the dipper. The dipper door is angled relative to the front wall at an acute angle when the dipper door is in the latched position.

In accordance with another construction, a dipper for a mining shovel includes a back wall, a first side wall extending from the back wall, a second side wall extending from the back wall, a front wall disposed opposite the back wall and extending between the first and second side walls, and a dipper door pivotally coupled to a bottom end of the dipper. The dipper door is movable between a latched and an unlatched position relative to the dipper. The back wall, the first side wall, the second side wall, and the front wall, and the dipper door define an interior cavity sized configured to hold material. The interior cavity includes an outer profile as viewed along a direction perpendicular to the first and second side walls that has a trapezoidal shape having no right angles.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
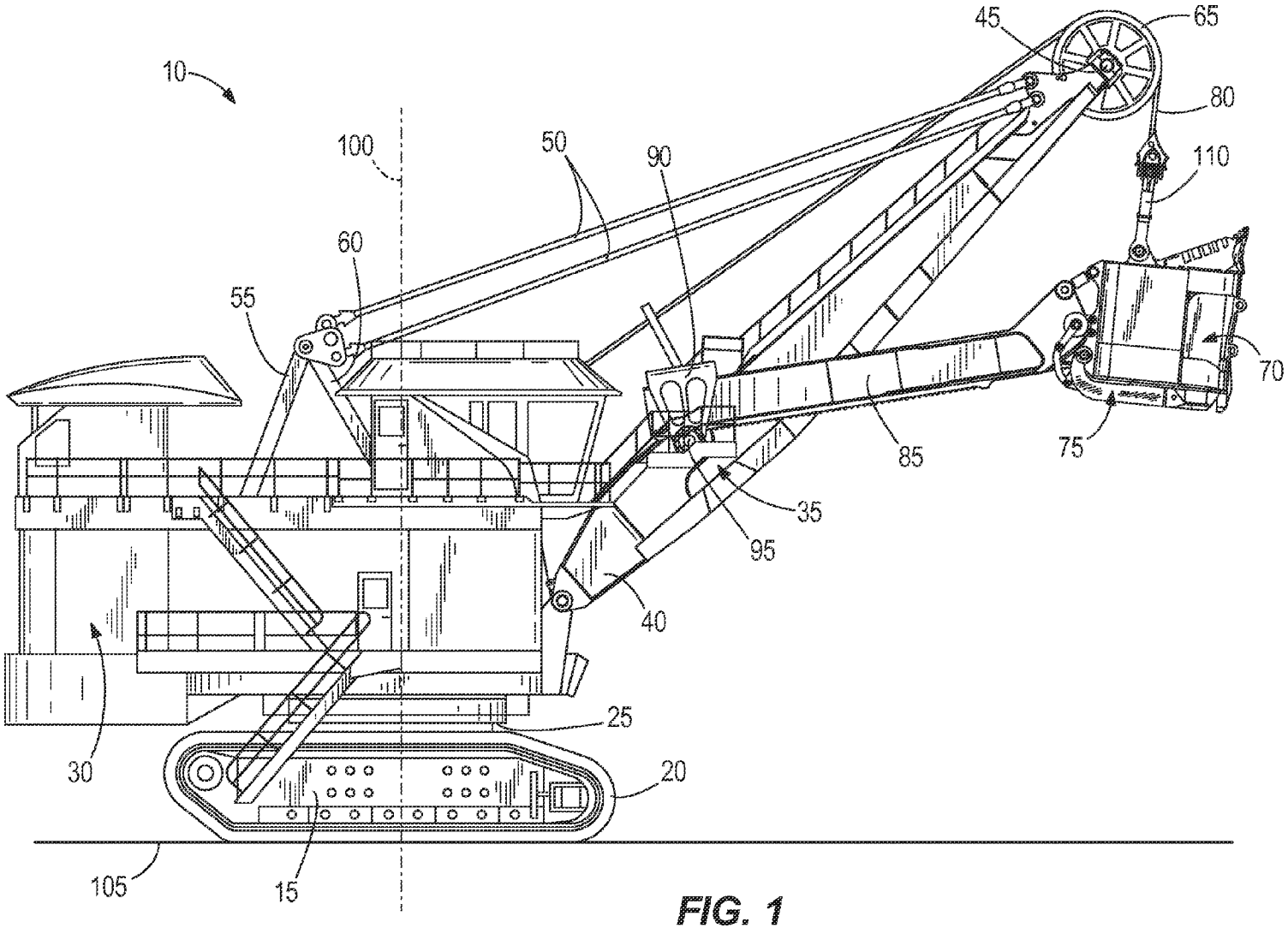
FIG. 1 is a side view of a mining shovel.

FIG. 1 illustrates a power shovel 10. The shovel 10 includes a mobile base 15, drive tracks 20, a turntable 25, a revolving frame 30, a boom 35, a lower end 40 of the boom 35 (also called a boom foot), an upper end 45 of the boom 35 (also called a boom point), tension cables 50, a gantry tension member 55, a gantry compression member 60, a sheave 65 rotatably mounted on the upper end 45 of the boom 35, a conventional dipper 70, a dipper door 75 pivotally coupled to the dipper 70, a hoist rope 80, a winch drum (not shown), a dipper handle 85, a saddle block 90, a shipper shaft 95, and a transmission unit (also called a crowd drive, not shown). The turntable 25 allows rotation of the upper frame 30 relative to the lower base 15. The turntable 25 defines a rotational axis 100 of the shovel 10. The rotational axis 100 is perpendicular to a plane 105 defined by the base 15 and generally corresponds to a grade of the ground or support surface.

The mobile base 15 is supported by the drive tracks 20. The mobile base 15 supports the turntable 25 and the revolving frame 30. The turntable 25 is capable of 360-degrees of rotation relative to the mobile base 15. The boom 35 is pivotally coupled at the lower end 40 to the revolving frame 30. The boom 35 is held in an upwardly and outwardly extending relation to the revolving frame 30 by the tension cables 50, which are anchored to the gantry tension member 55 and the gantry compression member 60. The gantry compression member 60 is mounted on the revolving frame 30.

The dipper 70 is suspended from the boom 35 by the hoist rope 80. The hoist rope 80 is wrapped over the sheave 65 and attached to the dipper 70 at a bail 110. The hoist rope 80 is anchored to the winch drum (not shown) of the revolving frame 30. The winch drum is driven by at least one electric motor (not shown) that incorporates a transmission unit (not shown). As the winch drum rotates, the hoist rope 80 is paid out to lower the dipper 70 or pulled in to raise the dipper 70. The dipper handle 85 is also coupled to the dipper 70. The dipper handle 85 is slidably supported in the saddle block 90, and the saddle block 90 is pivotally coupled to the boom 35 at the shipper shaft 95. The dipper handle 85 includes a rack and tooth formation thereon that engages a drive pinion (not shown) mounted in the saddle block 90. The drive pinion is driven by an electric motor and transmission unit (not shown) to extend or retract the dipper handle 85 relative to the saddle block 90.

An electrical power source (not shown) is mounted to the revolving frame 30 to provide power to a hoist electric motor (not shown) for driving the hoist drum, one or more crowd electric motors (not shown) for driving the crowd transmission unit, and one or more swing electric motors (not shown) for turning the turntable 25. Each of the crowd, hoist, and swing motors is driven by its own motor controller, or is alternatively driven in response to control signals from a controller (not shown).

Figure 2:
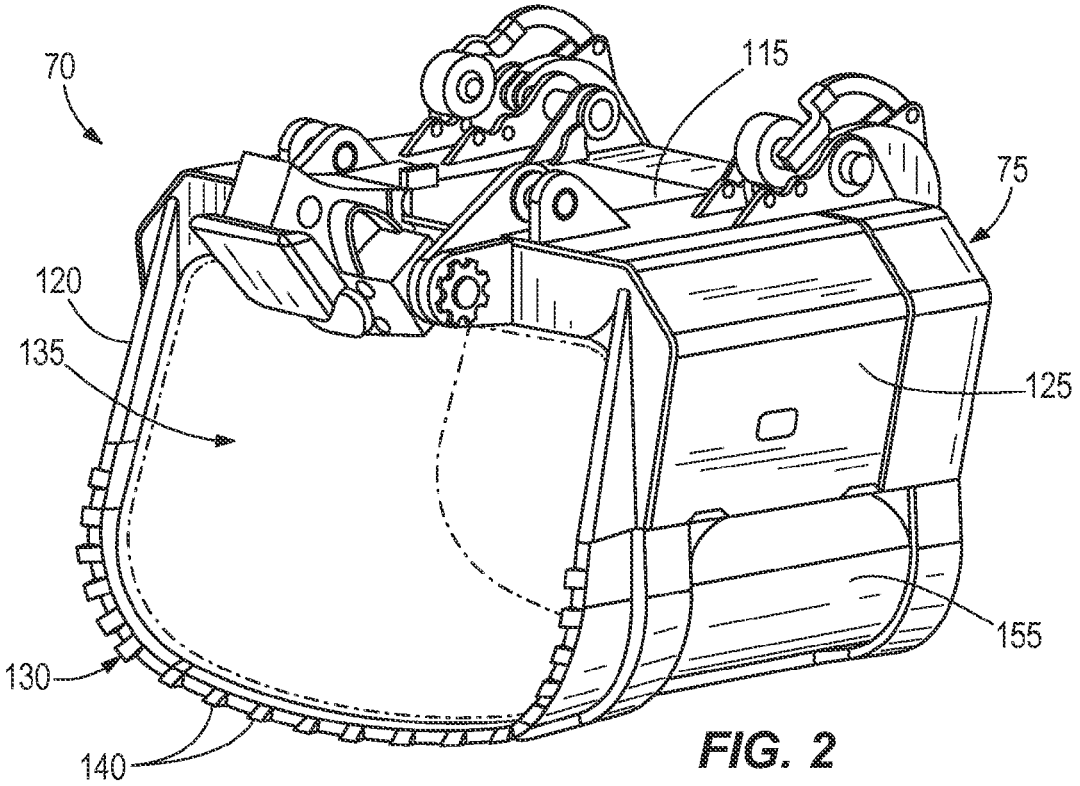
FIG. 2 is a perspective view of a conventional dipper for the mining shovel of FIG. 1.

With reference to FIGS. 1 and 2, the conventional dipper 70 has a back wall 115, a first side wall 120 (FIG. 1) extending from the back wall 115, a second side wall 125 (FIG. 2) extending from the back wall 115, and a front wall 130 disposed opposite the back wall 115. The front wall 130 extends between the side walls 120, 125. The back wall 115, the first side wall 120, the second side wall 125, the front wall 130, and the dipper door 75 define an interior cavity 135 sized to receive and hold material. As illustrated in FIGS. 1 and 2, the front wall 130 includes a plurality of teeth 140 along a top end 142 of the dipper 70 that extend away from the dipper door 75 to contact and engage a pile of material, and facilitate the movement of the material into the cavity 135. The dipper door 75 is pivotally coupled to a bottom end 144 of the dipper 70.

Figure 3:
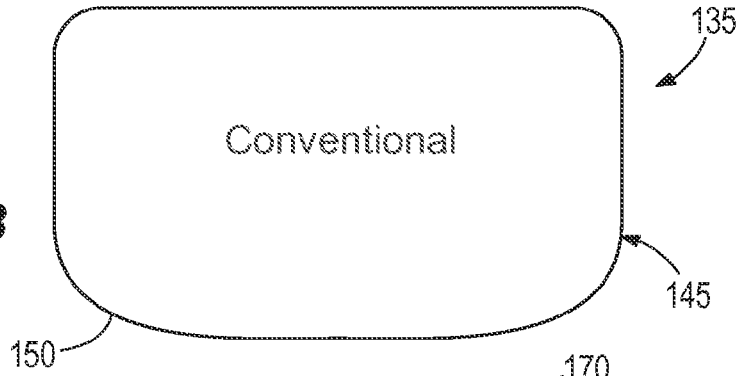
FIGS. 3 and 4 are profile views of a cavity of the dipper of FIG. 2.

With reference to FIGS. 1-3, the cavity 135 defines an outer profile 145 (FIG. 3), as viewed along a direction perpendicular to the dipper door 75 and parallel to the front wall 130, that is generally rectangular, with the exception of a more slightly rounded portion 150 that extends along the front wall 130 and transition regions 155 (one illustrated in FIG. 2) between the front wall 130 and the side walls 120, 125.

Figure 4:
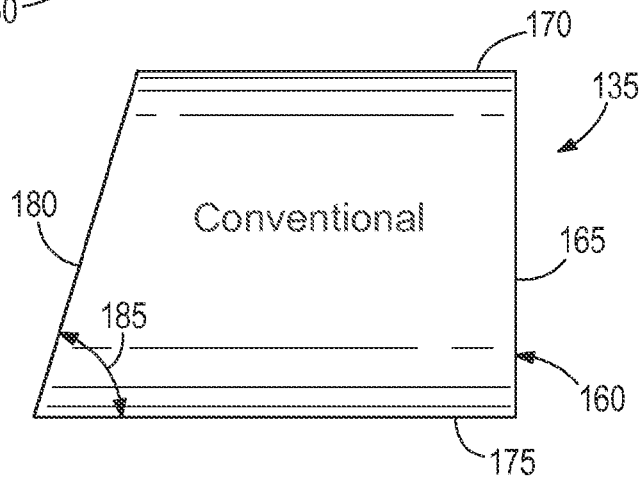

With reference to FIG. 4, the cavity 135 also has a side profile 160, as viewed along a direction perpendicular to the side walls 120, 125. The profile 160 includes a portion 165 that extends along the dipper door 75, a portion 170 that extends along the back wall 115, and a portion 175 that extends along the front wall 130. The portion 165 extends transverse to the portions 170 and 175. The profile 160 also includes an angled portion 180 that extends between the portions 170 and 175. The angled portion 180 is angled at an acute angle 185 relative to the portion 175.

While the profiles 145, 160 illustrated in FIGS. 3 and 4 are outer profiles of the cavity 135 (which alternatively can be considered as inner profiles of the dipper 70), the dipper 70 itself also includes outer profiles that are of identical, or substantially similar shape to that of the outer profiles 145, 160. In particular, the back wall 115, the first side wall 120, the second side wall 125, the front wall 130, and the dipper door 75 are each of a generally constant and similar thickness, such that overall outer profiles of the dipper 70 correspond to the outer profiles 145, 160 seen in FIGS. 3 and 4.

Figure 5:
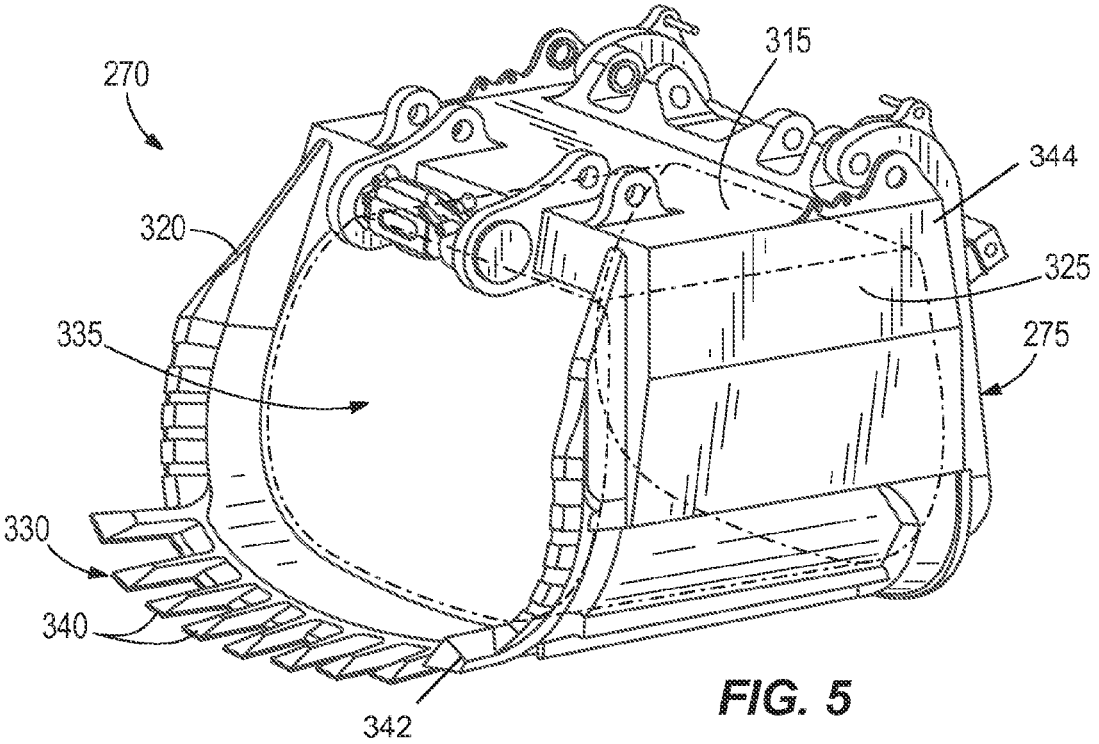
FIG. 5 is a perspective view of a dipper according to one construction of the invention.

With reference to FIGS. 5-8, a new dipper 270 according to one construction is illustrated. Similar to the dipper 70, the dipper 270 is coupled to a dipper door 275 and includes a back wall 315, a first side wall 320 extending from the back wall 315, a second side wall 325 extending from the back wall 315, and a front wall 330 disposed opposite the back wall 315. The front wall 330 extends between the side walls 320, 325. The back wall 315, the first side wall 320, the second side wall 325, the front wall 330, and the dipper door 275 define an interior cavity 335 sized to receive and hold material. As illustrated in FIG. 5, the front wall 330 includes a plurality of teeth 340 along a top end 342 of the dipper 270 that contact and engage a pile of material, and facilitate the movement of material into the cavity 335. The dipper door 275 is pivotally coupled to a bottom end 344 of the dipper 270.

Figure 6:
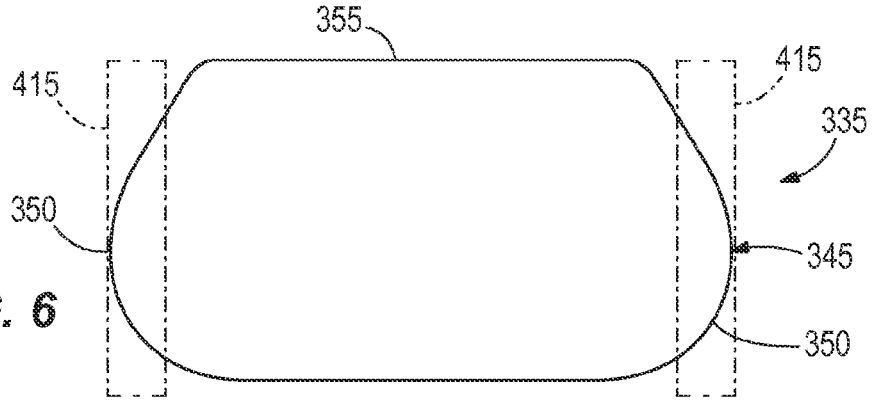
FIGS. 6 and 7 are profile views of a cavity of the dipper of FIG. 5.

With reference to FIG. 6, the cavity 335 defines an outer profile 345 (FIG. 6), as viewed along a direction parallel to the front wall 330 and toward the dipper door 275 (and parallel to the side walls 320, 325), that is substantially more rounded than the profile 145. In particular, the profile 345 includes rounded portions 350 that extend in a curved manner (e.g. are bowed outwardly) along substantially all or all the first and second side walls 320, 325. The profile 345 also includes a narrowed region 355 that extends along the back wall 315.

Figure 7:
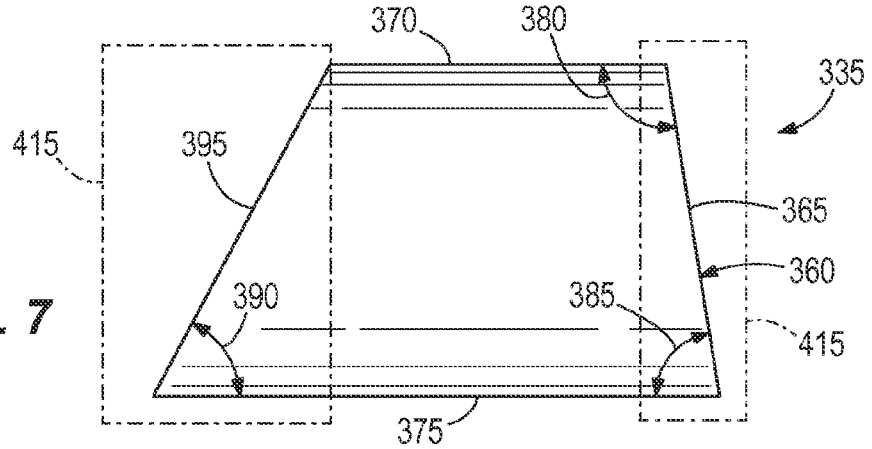

With reference to FIG. 7, the cavity 335 also has a profile 360, as viewed along a direction perpendicular to the side walls 320, 325 that is different than the profile 160. The profile 360 has a trapezoidal shape that does not include any right angles, whereas the profile 160 has a right trapezoidal shape that includes two right angles. The profile 360 includes a portion 365 that extends along the dipper door 275, a portion 370 that extends along the back wall 315, and a portion 375 that extends along the front wall 330. In contrast to the dipper 70, the portion 365 is not transverse to the portions 370 and 375. Rather, the portion 365 is angled at an obtuse angle 380 relative to the portion 370 and at an acute angle 385 relative the portion 375. In some constructions, the angle 380 is approximately 100 degrees, and the angle 385 is approximately 80 degrees. In some constructions, the angle 380 is between approximately 95 degrees and 105 degrees, and the angle 385 is between approximately 75 degrees and 85 degrees. Other constructions include different ranges and values for the angles 380, 385.

With continued reference to FIG. 7, the profile 360 also includes an acute angle 390 between the portion 375 and a portion 395 that extends between the portion 375 and the portion 370. As illustrated in FIGS. 4 and 7, the angle 390 is slightly smaller than the angle 185, although in some constructions the angles 390 and 180 are identical or substantially similar.

While the profiles 345, 360 illustrated in FIGS. 6 and 7 are outer profiles of the cavity 335 (which alternatively can be considered as inner profiles of the dipper 270), the dipper 270 itself also includes outer profiles that are of identical, or substantially similar shape to the outer profiles 345, 360. In particular, the back wall 315, the first side wall 320, the second side wall 325, the front wall 330, and the dipper door 275 are each of a generally constant and similar thickness, such that the overall outer profiles of the dipper 270 correspond to the outer profiles 345, 360 seen in FIGS. 6 and 7.

Figure 8:
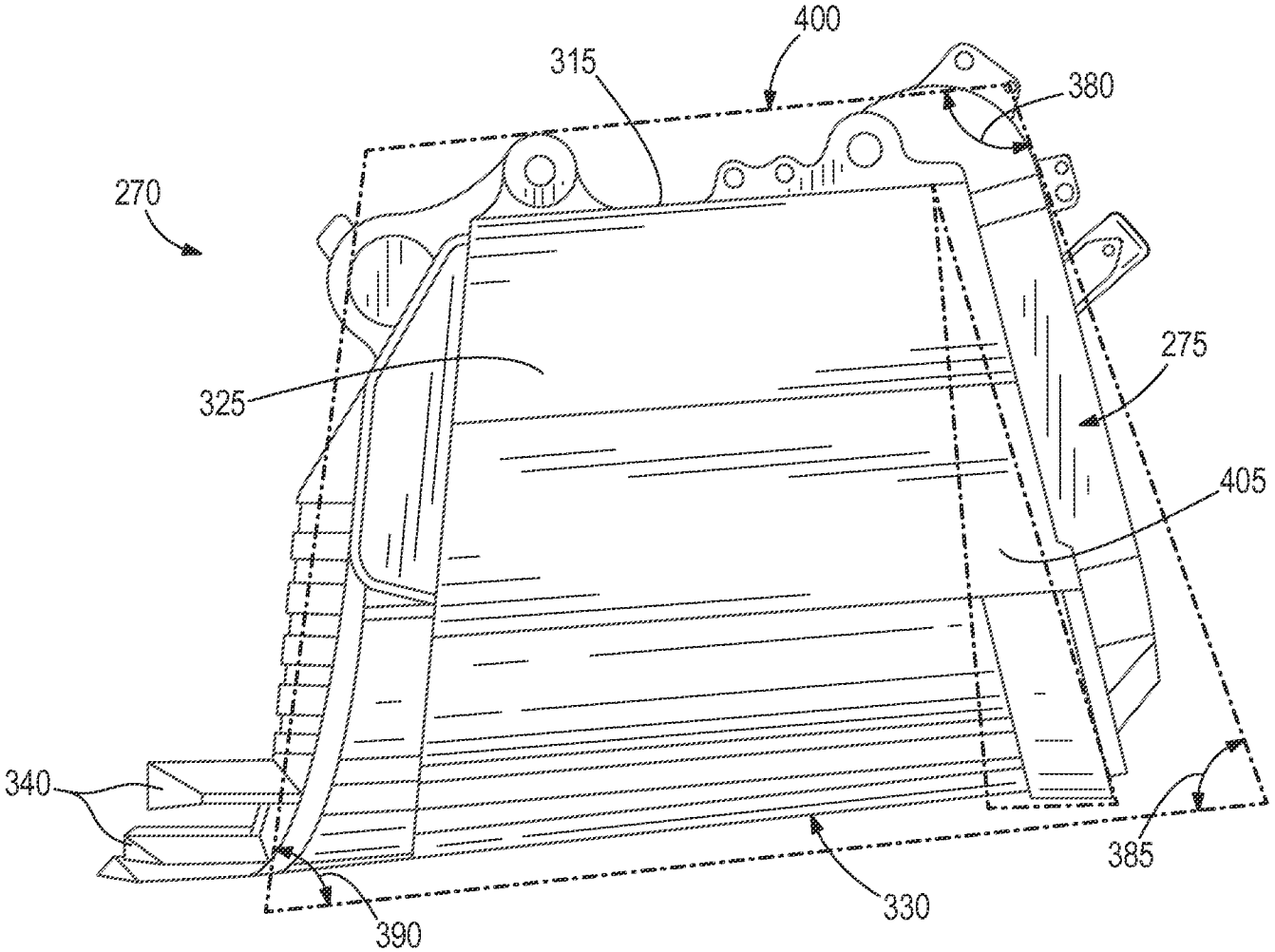
FIG. 8 is a side view of the dipper of FIG. 5, illustrating an overall profile of the dipper.

For example, and with reference to FIG. 8, the dipper 270 includes an outer profile 400 that encompasses substantially the entire dipper 270. As illustrated in FIG. 8, the dipper door 275 is angled relative to both the back wall 315 and the front wall 330 by the same angles 380, 385 as seen in the profile 360 of the cavity 335. The outer profile 400 also includes the same angle 390 as the profile of the cavity 335.

With continued reference to FIG. 8, the angled orientation of the dipper door 275, and the overall outer profile 400 of the dipper 70, forms a triangular region 405 in the dipper 270 that is not present in the dipper 70. In some constructions, this region 405 provides added capacity in the cavity 335 (e.g., 5% more, 10% more, 20% more, etc.) for receiving material, as compared to the cavity 135. In some constructions, the dipper 270 is sized for 84 CYD (cubic yards) per SAE J67.

The profiles 345, 360, and 400 of the dipper 270 illustrated in FIGS. 5-8 give the dipper 270 significant competitive advantages over the conventional dipper 70.

Figure 9:
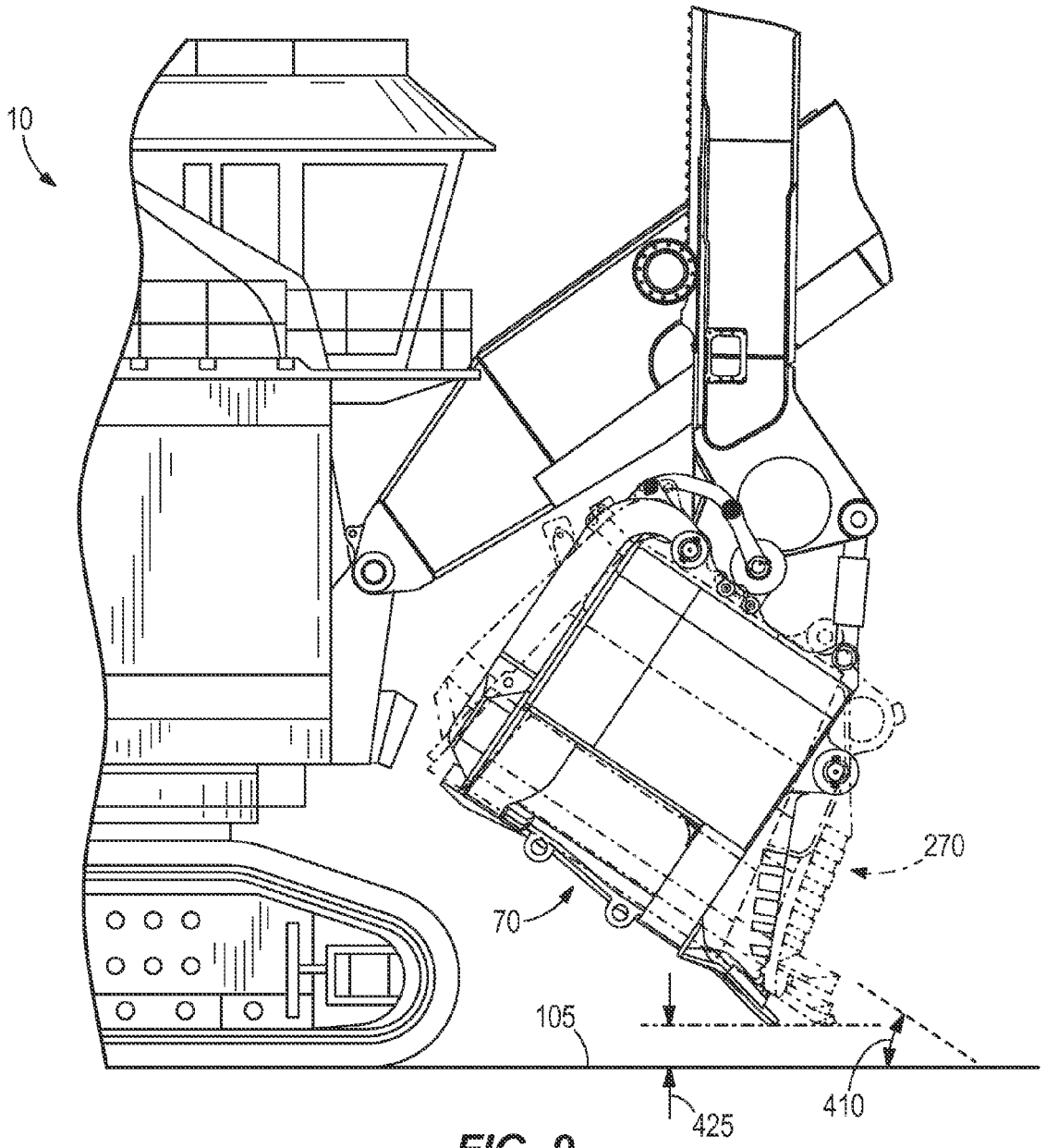
FIG. 9 is a side, comparison view of the dippers of FIG. 2 and FIG. 5, illustrating a tuck position.

First, and with reference to FIGS. 8 and 9, the dipper door 275 latches sooner in a tuck motion (FIG. 9) as compared to the dipper door 75 on the dipper 70. In particular, if the angle 380 is 100 degrees, the dipper door 275 will latch with the dipper 270 at a tuck angle 410 that is 10 degrees less (or sooner) than typically encountered with the dipper door 75 and the dipper 70. Thus, the dipper 270 and the dipper door 275 do not need to be pulled back and up as far during a tuck motion in order to cause the dipper door 275 to pivot down and latch with the dipper 270, allowing the operator to start a dig cycle sooner (or more quickly) than usual. This results in reduced cycle time and overall increased production. Similarly, if the angle 380 is 95 degrees, the dipper door 275 will latch at a tuck angle 410 that is 5 degrees sooner, and if the angle is 110 degrees, the dipper door will latch at a tuck angle 410 that is 20 degrees sooner, etc. Thus, the angle 380 (less 90 degrees) is identical to the decrease in the tuck angle 410 required to latch the dipper door 275.

Second, the profiles 345, 360, and 400 of the dipper 270 improve filling of the dipper 270. Conventionally, a dipper volume is calculated by assuming the dipper cavity 135 fills completely, all the way up to the back wall 115. In some constructions of the dipper 270, the same assumption is made, but the dipper 270 is less dependent on the filled volume near the back wall 315 because of the added capacity of the triangular region 405 illustrated in FIG. 8. Thus, it is less important that the dipper 270 is filled all the way up to the back wall 315. This is particularly advantageous because in practical experience, dippers rarely fill in the corners and along the back wall 315. The added volume in the triangular region 395 creates added capacity where the material is initially entering the cavity 335.

Additionally, and with reference to FIGS. 6 and 7, in some constructions one or more of the angles 380, 385, and 390, along with the rounded portions 350, create added dipper capacity zones 415 (as illustrated in dashed lines). In some constructions, these zones add 5%, 10%, 20%, etc. more capacity to the dipper 270 as compared to the dipper 70.

Third, in some constructions, the dipper 270 has improved weight efficiency over the dipper 70. In particular, because of the profiles 345, 360, 400, and the larger capacity near the front wall 330, in some constructions the back wall 315 is made smaller in width (e.g., as measured along a direction perpendicular to the dipper door 75 in FIG. 2) or overall size. In some constructions, the back wall 315 is 5% smaller, 10% smaller, 20% smaller, or more than a typical dipper 70, while still maintaining the same or even greater capacity than the dipper 70. This reduction in the size of the back wall 315 aids in significant weight reduction for the dipper 70 (e.g., 5%, 10%, 20% or more in reduction of weight), as the back wall of a dipper typically incurs the greatest amount of weight on a dipper. A lighter dipper for a given capacity allows for increased levels of cutting force, resulting in increased production.

Fourth, the dipper 270 provides an increased flat floor clean-up and reach versus the dipper 70. For example, and with reference to FIG. 10, the dipper 270 is able to extend generally parallel to the plane 105 for a greater distance 420 than with the dipper 70. This added flat floor clean-up and reach distance 420 enables the dipper 270 to stay close to the plane 105 longer, and to thereby pick up more material. In some constructions the dipper 270 has an added flat floor clean-up and reach distance 420 that is approximately four feet. Other constructions include different values and ranges, including ranges that exceed four feet.

Figure 10:
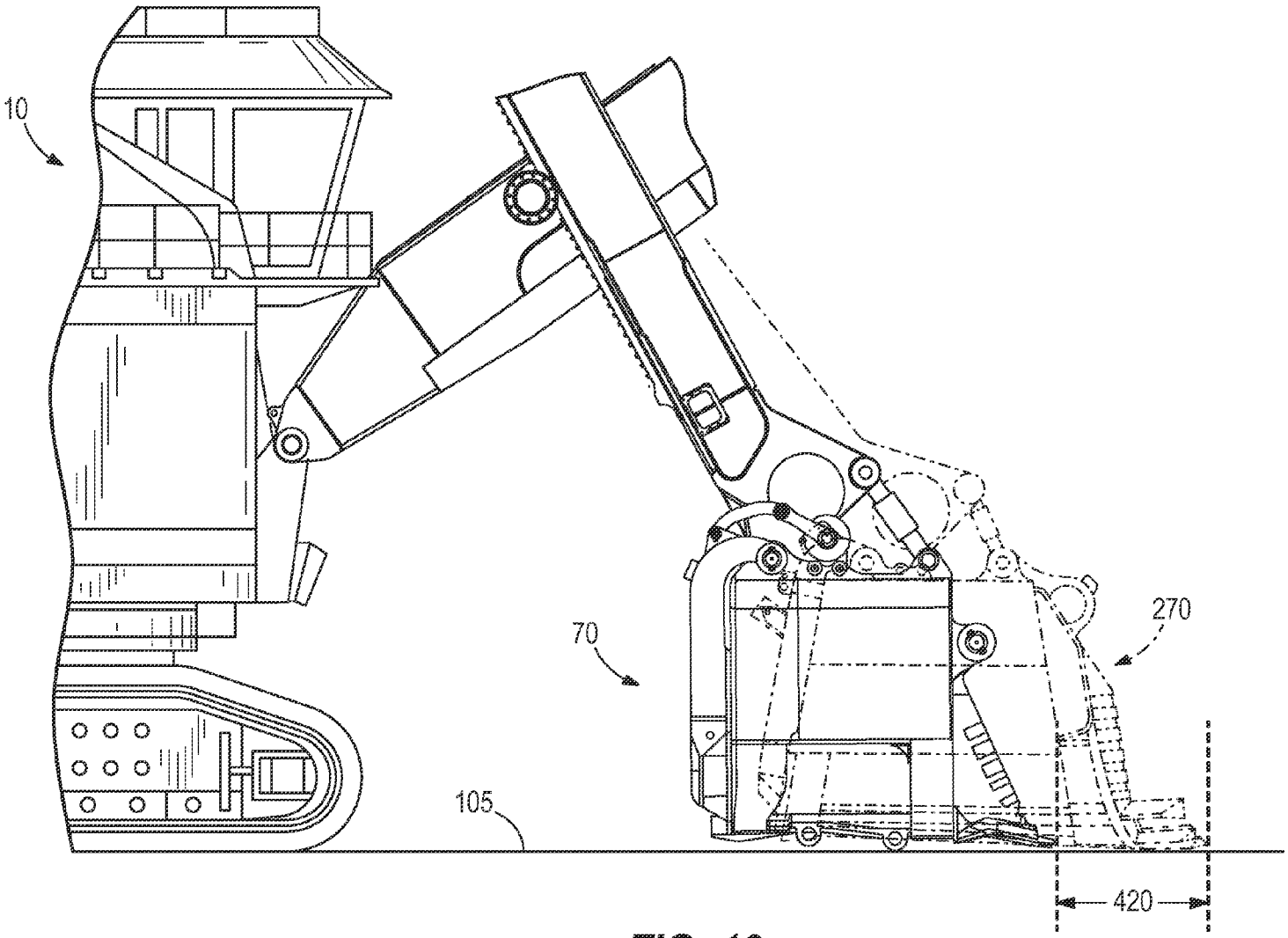
FIG. 10 is a side, comparison view of the dippers of FIG. 2 and FIG. 5, illustrating a flat floor clean-up and reach position.

With reference to FIG. 9, while the shape of the dipper 270 may reduce the degree to which the dipper 270 can be tucked up against the shovel 10 (e.g., thereby affecting a swinging dig path), overall a tooth-to-ground clearance 425 generally remains the same for both the dipper 70 and the dipper 270. Additionally, any loss or disadvantage in the ability to tuck the dipper 270 back as far as the dipper 70 is more than made up for by the increased flat floor clean-up and reach 420 as shown in FIG. 10. Thus, overall, the shape of the dipper 270 allows shovel operators to maneuver the shovel 10 to optimum positions for digging, maintaining a flat floor, and maximizing production.

While the dipper 270 described above has been described in the context of having both an angled profile in the area of the dipper door 275 (i.e., via angles 380 and 385) as well as in a loading or "lip" area (i.e., via the angle 390), in some constructions the angle 390 is 90 degrees, such that the profile 360 of the dipper 270 is still trapezoidal, but with only a single angled region (i.e., corresponding to the dipper door 275 and the triangular region 405 formed near the dipper door 275).

Although the invention has been described in detail with reference to certain preferred embodiments, variations and modifications exist within the scope and spirit of one or more independent aspects of the invention as described.

What is claimed is:

1. A dipper for a mining shovel, the dipper comprising:

a back wall;

a first side wall extending from the back wall;

a second side wall extending from the back wall;

a front wall disposed opposite the back wall and extending between the first and second side walls, the front wall having a first end and a second, opposite end, wherein a plurality of dipper teeth are coupled to the first end; and a dipper door pivotally coupled to a bottom end of the dipper, the dipper door movable between a latched and an unlatched position relative to the dipper;

wherein the dipper door is angled relative to the front wall at an acute angle when the dipper door is in the latched position, wherein the acute angle is between 75-85 degrees, and wherein a distance between the first end and the second end of the front wall is greater than a distance between the front wall and the back wall.

2. The dipper of claim 1, wherein the back wall, the first side wall, the second side wall, the front wall, and the dipper door define an interior cavity sized configured to hold material, wherein the interior cavity defines an outer profile as viewed along a direction parallel to the front wall that includes portions that extend in a curved manner along the first and second side walls.

3. The dipper of claim 2, wherein the portions are bowed outwardly.

4. The dipper of claim 1, wherein the back wall, the first side wall, the second side wall, the front wall, and the dipper door define an interior cavity sized and configured to hold material, wherein the interior cavity includes an outer profile as viewed along a direction perpendicular to the first and second side walls that has a trapezoidal shape having no right angles.

5. The dipper of claim 4, wherein the profile includes a first portion that extends along the dipper door, a second portion that extends along the back wall, and a third portion that extends along the front wall, wherein the first portion is angled relative to the second portion at an obtuse angle.

6. The dipper of claim 5, wherein the obtuse angle is between approximately 95 and 105 degrees.

7. The dipper of claim 5, wherein the acute angle is a first acute angle, wherein the profile includes a fourth portion that extends between the second and third portions, and wherein the fourth portion is angled relative to the third portion at a second acute angle.

8. The dipper of claim 7, wherein the third portion is angled relative to the first portion at the first acute angle.

9. The dipper of claim 8, wherein the first acute angle is approximately 80 degrees.

10. The dipper of claim 1, wherein the back wall, the first side wall, the second side wall, the front wall, and the dipper door define an interior cavity sized configured to hold material, wherein the interior cavity includes an outer profile as viewed along a direction perpendicular to the first and second side walls that has a first trapezoidal shape, wherein the profile includes a first portion that extends along the dipper door, a second portion that extends along the back wall, a third portion that extends along the front wall, and a fourth portion that extends between the second and third portions, and wherein the dipper further includes an outer profile as viewed along the direction perpendicular to the first and second side walls that has a second trapezoidal shape, wherein both the first and second trapezoidal shapes have no right angles.

11. The dipper of claim 1, wherein the front wall is parallel to the back wall.

12. A mining shovel including the dipper of claim 1.

13. The dipper of claim 8, wherein the first acute angle and the obtuse angle together are greater than 180 degrees.

14. A dipper for a mining shovel, the dipper comprising:

a back wall;

a first side wall extending from the back wall;

a second side wall extending from the back wall;

a front wall disposed opposite the back wall and extending between the first and second side walls; and a dipper door pivotally coupled to a bottom end of the dipper, the dipper door movable between a latched and an unlatched position relative to the dipper;

wherein the back wall, the first side wall, the second side wall, the front wall, and the dipper door define an interior cavity sized and configured to hold material, wherein the interior cavity includes an outer profile as viewed along a direction perpendicular to the first and second side walls that has a trapezoidal shape having no right angles.

15. The mining machine of claim 14, wherein the profile includes a first portion that extends along the dipper door, a second portion that extends along the back wall, and a third portion that extends along the front wall, wherein the first portion is angled relative to the second portion at an obtuse angle.

16. The dipper of claim 15, wherein the obtuse angle is between approximately 95 and 105 degrees.

17. The dipper of claim 15, wherein the profile includes a fourth portion that extends between the second and third portions, wherein the fourth portion is angled relative to the third portion at an acute angle.

18. The dipper of claim 17, wherein the acute angle is a first acute angle, and wherein the third portion is angled relative to the first portion at a second acute angle.

19. The dipper of claim 18, wherein the second acute angle is between approximately 75 and 85 degrees.

20. The dipper of claim 14, wherein the front wall includes a plurality of dipper teeth that extend away from the dipper door.

21. A mining shovel including the dipper of claim 14.

22. The dipper of claim 18, wherein the front wall has a first end and a second, opposite end, wherein a plurality of dipper teeth are disposed at the first end, and wherein a distance between the first end and the second end of the front wall is greater than a distance between the front wall and the back wall.

23. The dipper of claim 18, wherein the second acute angle and the obtuse angle together are greater than 180 degrees.

24. The dipper of claim 18, wherein the second acute angle is between 75 and 85 degrees, wherein the front wall has a first end and a second, opposite end, wherein a plurality of dipper teeth are disposed at the first end, wherein a distance between the first end and the second end of the front wall is greater than a distance between the front wall and the back wall, and wherein the second acute angle and the obtuse angle together are greater than 180 degrees.

* * * * *